US012584719B2

(12) United States Patent
Rowe et al.

(10) Patent No.: US 12,584,719 B2
(45) Date of Patent: Mar. 24, 2026

(54) END CAP

(71) Applicant: BAE SYSTEMS plc, London (GB)

(72) Inventors: Nathan William Rowe, Crewe (GB); Joshua Matthew Stubbs, Crewe (GB); Richard James Duncombe, Farnborough (GB)

(73) Assignee: BAE SYSTEMS PLC, London (GB)

( * ) Notice: Subject to any disclaimer, the term of this patent is extended or adjusted under 35 U.S.C. 154(b) by 110 days.

(21) Appl. No.: 18/558,964

(22) PCT Filed: Apr. 19, 2022

(86) PCT No.: PCT/GB2022/050968

§ 371 (c)(1),
(2) Date: Nov. 3, 2023

(87) PCT Pub. No.: WO2022/234246

PCT Pub. Date: Nov. 10, 2022

(65) Prior Publication Data

US 2024/0230290 A1 Jul. 11, 2024

(30) Foreign Application Priority Data

May 5, 2021 (EP) ..... 21275053
May 5, 2021 (GB) ..... 2106388

(51) Int. Cl.

| | |
|---|---|
| ***F42B 5/285*** | (2006.01) |
| ***F42C 19/08*** | (2006.01) |
| *F42B 5/18* | (2006.01) |
| *F42B 5/307* | (2006.01) |

(52) U.S. Cl.

CPC ..... *F42B 5/285* (2013.01); *F42C 19/083* (2013.01); *F42B 5/181* (2013.01); *F42B 5/307* (2013.01)

(58) Field of Classification Search

CPC .... F42B 5/181; F42B 5/26; F42B 5/28; F42B 5/285; F42B 5/30; F42B 5/307; F42C 19/083

USPC ..... 102/464–470

See application file for complete search history.

(56) References Cited

U.S. PATENT DOCUMENTS 4,494,461 A * 1/1985 Pryor ..... B21J 5/004 86/19.5
12,158,330 B2 * 12/2024 Rowe ..... F42B 5/285
2014/0224144 A1 * 8/2014 Neugebauer ..... F42B 5/26 102/470

(Continued)

FOREIGN PATENT DOCUMENTS

CA 2570743 A1 * 6/2008 ..... F42B 5/307
WO 2022234246 A1 11/2022

OTHER PUBLICATIONS

International Search Report and Written Opinion received for PCT/GB2022/050968. Mailed: Jul. 20, 2022. 11 pages.

(Continued)

*Primary Examiner* — James S Bergin
(74) *Attorney, Agent, or Firm* — Arcane Law PLLC

(57) ABSTRACT

The invention relates to a method of improved ammunition production, particularly to a metal matrix composite (MMC) end cap, suitable for forming a cartridge case, said end cap comprising an admixture of a metal powder, a binder matrix material, wherein said admixture has been caused to solidify in the shape of said end cap.

20 Claims, 6 Drawing Sheets

(56) References Cited

U.S. PATENT DOCUMENTS

| | | | | |
|---|---|---|---|---|
| 2016/0003601 | A1* | 1/2016 | Burrow | C22C 38/58 102/467 |
| 2017/0089674 | A1* | 3/2017 | Burrow | F42B 5/285 |
| 2018/0065183 | A1* | 3/2018 | Skowron | B22F 3/225 |
| 2018/0066925 | A1 | 3/2018 | Skowron et al. | |
| 2018/0321020 | A1 | 11/2018 | Evans | |
| 2019/0011232 | A1 | 1/2019 | Boss et al. | |
| 2019/0310059 | A1 | 10/2019 | Burrow | |
| 2020/0400411 | A9 | 12/2020 | Burrow | |
| 2024/0219157 | A1* | 7/2024 | Rowe | F42B 5/307 |
| 2024/0230291 | A1* | 7/2024 | Rowe | F42B 5/307 |

OTHER PUBLICATIONS

Search Report under Section 17(5) received for GB Application No. 2106388.8, dated Oct. 25, 2021. 3 pages.
Extended EP Search Report received for EP Application No. 21275053.3, dated Oct. 21, 2022. 7 pages.

* cited by examiner

END CAP

The invention relates to an improved ammunition end cap, more specifically to a lightweight metal matrix composite end cap, suitable for use with lightweight metal and polymer tube cartridges.

The manufacture of rounds for use in small arms follows a standardised process and involves the separate construction of a projectile and a case the latter comprising a primer and a propellant to propel the projectile. Both the case and projectile are typically formed from a ductile material that is capable of being reshaped through a series of dies. The projectile and case components are joined as part of the final stages of the process to form the round, which then undergoes a quality check.

The formation of brass cartridge cases is well known in the art, the cartridge cases are initially formed from a metal cup, these are commonplace components used in the drawing process for high velocity rounds, those typically used in rifled barrels. The metal cup is typically passed through a series of dies to form a longer, thinner metal cylinder. The base of the metal case tube is shaped to receive a percussion cap (primer cap) and ejection grooves, and end cap.

To reduce the burden on the user, new lightweight materials such as modern engineering polymers and stainless steel are being used in place of brass for the case.

According to a first aspect of the invention there is provided a metal matrix composite end cap, suitable for forming a cartridge case, said end cap comprising an admixture of a metal powder, a binder matrix material, wherein said admixture has been caused to solidify in the shape of said end cap.

The end cap (head stamp) comprises a rim, typically an ejector groove for locating with an ejection mechanism, a first cavity the cap chamber for receiving a primer cap, and a second cavity—a fire hole, which is through-hole through which the primer cap's energetic output travels to initiate the gun propellant located in the adjoining cartridge case.

The metal powder may selected from any metal powder or alloy thereof, preferably a metal with a density lower than (10 $gcm^{-3}$, more preferably lower than 8 $gcm^{-3}$, such as for example aluminium, magnesium, titanium, cobalt, copper, zinc.

The metal powder may have a particulate size in the range of from nano to mm, preferably the average longest dimension is sub-micron to 100 micron. The use of bimodal or multimodal compositions may provide an increase density.

The metal powder may be present in the range of from a lower limit of 1%, to 5% by weight of the reinforcement material of the reinforcement material to an upper limit of 50%, 40%, 30%, 20%, or 10%.

The binder matrix may be selected from a further metal powder, polymers, or ceramics. The binder matrix may be present in the range of from at a concentration ranging from a lower limit of 5% to 70% by weight.

The further metal powder when it acts as a binder matrix will have a lower density than the metal powder. The further metal powder may be independently selected from the same metals as the metal powders, preferably the further metal powder may have a density lower than 8 $gcm^{-3}$, such as, for example aluminium, magnesium, titanium. The further metal powder may have a particulate size in the range of from nano to mm, preferably the average longest dimension is sub micron to 100 micron. The use of bimodal or multimodal compositions of the further metal powder and the metal powder, may be formed.

Non-limiting examples of the further metal binder material may include copper-phosphorus, copper-phosphorous-silver, copper-nickel, copper-manganese-nickel, copper-manganese-phosphorous, copper-manganese-zinc, copper-manganese-nickel-zinc, copper-nickel-indium, copper-tin-manganese-nickel, copper-tin-manganese-nickel-iron, gold-palladium-nickel, gold-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-phosphorus, nickel-silicon-chromium-boron-iron, nickel-manganese, copper-aluminum-nickel-zinc-tin-iron, copper-aluminum-nickel, copper-aluminum, copper-aluminum-nickel-iron, and the like, and any combination thereof.

The polymer binder may be any polymer or graphite, the polymer binder may be such as for example be a resin binder, such as for example acrylate binder such as, for example, methylmethacrylate MMA), an acrylic binder, an epoxy binder, a urethane & epoxy-modified acrylic binder, a polyurethane binder, an alkyd based binder.

The ceramic binder may be independently selected from, oxides, such as those of alumina, beryllia, ceria and zirconia, or non-oxides, such as carbides, carbides, nitrides or silicides, and composites of oxides and non-oxides.

The following is a non-exhaustive list of examples of MMC composites, such as, for example aluminium based composites, magnesium based composites, copper based composites, less preferably titanium, zinc or lead based composites. For example aluminium as matrix can be either cast alloy or wrought alloy, such as for example, AlMg, AlSiC, AlCuSiMn, AlZnMgCu, AlCu, AlMgSi, AlSiCuMg.

The mixed metal matrix composites typically have a density of less than 4 $g/cm^3$, some less than 3 $g/cm^3$ or even 2 $g/cm^3$. Preferably the MMC material is selected with a density of less than 3 $g/cm^3$.

The MMC composites have a density in the range of greater than 50% less than stainless steel 8 $g/cm^3$ and 8.74/$cm^3$ for brass.

For a typical stainless steel end cap for a 5.56 mm round, the volume is 0.27 $cm^3$, with a mass of 2.16 g (density 8 $g/cm^3$)

For the same end cap ie the same volume, made from a typical MMC with a density 4 $g/cm^3$, the mass is around 1.08 g.

The reduction of mass of 50% of the end cap, provides a significant reduction of the final completed cartridge case (end cap and case tube). This mass when multiplied over 1,000 rounds, provides a significant 1 kg weight saving. Further when scaled for large volumes of 100,000s of rounds, this allows different logistics to be used.

The admixture may further comprise reinforcement materials, so as to form a hybrid composite, that is a mixture which comprise at least three components (metal powder, binder and reinforcement). The reinforcement may be continuous (monofilament or multifilament) or discontinuous the addition of wires, short fibres, whiskers or particulates, such as graphitic materials and or ceramic materials, such as, for example $ZrO_2$, TiC, TiN, AlN, graphite, clay, SiC, $Al_2O_3$, and $B_4C$ The use of fibre or particulates may be in the range of from 0.1-50% vol fraction, preferably greater than 10%.

The reinforcement materials may have an average longest diameter ranging from a lower limit of sub-micron, preferably in the range of 1 to 1000 microns, preferably an upper limit of 1000 microns.

The admixture of metal powder, binder matrix and reinforcement material providing 100% by weight.

The end cap admixture (depending on the binder matrix materials selected) may be fabricated by any known means. Typical MMC fabrication techniques may be solid state methods, liquid state methods, additive layer (3D printing). Solid state methods may be power blending and consolidation (sintering such as hot isostatic pressing), diffusion bonding, physical vapour deposition. Liquid processing may stir or squeeze casting, infiltration spray deposition. The processing may also be in-situ processing such as chemical curing.

It will be clear that the method chosen will depend on the constituents of the metal powder and the binder matrix selected.

According to a further aspect of the invention there is provided an ammunition round, comprising an end cap as defined herein, a case, (said case and end cap forming a cartridge case) primer, propellant and a projectile located in said cartridge case arranged to form said ammunition round.

The case material may be any commonly used material such as a metal especially non-brass metals, a polymer case or an MMC material as defined herein for the end cap. The use of a brass case in this combination, adds mass, so whilst not desirable, the combination is conceivable. The metal case may be a steel, titanium or other lightweight metals The cartridge case, that is the end cap and case may contain only MMC materials, such that the entire case may be formed in a single operation.

In a preferred arrangement the cartridge case may be formed by the joining of the MMC end cap as defined herein and a metal case, the join may be mechanically joined, welded, adhesively bonded or combination thereof.

Preferably a stainless steel case may be joined to the MMC end cap by a mechanical a rivet join with a sealant or weather seal between the end cap and case.

The MMC end cap in may be formed in-situ on the metal case, such that the formation of the MMC end cap also fastens the MMC end cap to the metal case.

The use of polymer cases is gaining momentum, however, they have all relied on using brass end caps, for ease and cost. The polymer case may be formed in-situ with the end cap as defined herein, in order to allow the adhesion of the polymer case to the end cap. The end cap may further comprise an elongate protrusion to provide a greater surface area of engagement with said polymer case. The polymer case can be formed separately from the end cap and the two components joined by heating or adhesively bonding the two together.

The elongate protrusion may further comprise surface projections, surface keying, to provide further increase in the strength of the mating between the MMC end cap and the polymer case. Surface projections may interlock with any fibrous ply or fibrous filler material in the polymer case, to provide further strength with a fibre reinforced polymer composite case.

The polymer case may be formed in-situ around the MMC end cap, by metal insert moulding techniques. Some part or all of the polymer case and/or polymeric coupling may be integrally formed by metal insert moulding. The MMC end cap may in a preferred process be loaded into a die cavity where a polymeric material is moulded around it to form a casing which will provide the final net shape for the cartridge case.

Metal insert moulding is the insertion of a metal component during the moulding, casting, forming process of a polymer component and is well known to those proficient in said art. The MMC end cap may be inserted before, during or even post forming process, before the polymer moulding process has resulted in a final cured product. The polymer moulding processes may be selected from any known process, such as, for example, injection, compression, GRP, extrusion, extrusion blow moulding, SMC/DMC, structural foam, and rotational moulding.

The polymeric case when formed as a separate component may be affixed to the metal coupling protrusion by a thermal weld, ultrasonic weld, heat shrink, adhesive, crimp, clamped, interlocked with said metal protrusion, to form a gas tight seal. The weld may be any thermal heat source, such as, for example induction, flame, laser or ultrasonic.

The polymer case may comprise multiple sections, such as, for example a polymeric coupling end, and an open end (mouth) for receiving a projectile, or the mouth end may be closed for forming a blank.

The polymer case may comprise one or more intermediate sections. The sections, polymeric coupling end, and projectile/blank end may have different rigidities, and physical properties. The polymer case may have one, two, three or more sections, each section may be independently selected from a different polymer, or the same polymer with different chemical or physical properties, depending on densities, curing agents, curing process, fillers, fibres or other additives.

The polymer case may be formed as a monolithic polymer case. The monolithic polymer case may have different chemical or physical properties, at various points along its construction, by, varying densities or variable loading of fillers, fibres or other additives therein.

The polymer case may be located at least in part over the outer diameter of the second open end of the closed MMC end cap.

In one arrangement there may be a further circumferential groove below the ejector groove, to accommodate a retaining portion of polymer case.

The polymer case preferably comprises a polymeric coupling end, which engages with the elongate protrusion. The polymeric coupling end and elongate protrusion may be a male and female co-operative locking arrangement.

In a preferred arrangement the polymeric coupling end is a female coupling portion. Preferably the female coupling portion comprises two polymeric skirt portions which engage with the elongate protrusion. The two skirt portions may envelope the elongate protrusion. The two skirt portions may be an outer skirt portion and an inner skirt portion. The outer skirt portion may form part of the outside of the polymeric case. The outer polymeric skirt portion may comprise the retaining portion, which engages with the further circumferential groove, which is located under the ejection groove.

The inner skirt portion goes inside the head unit, which will form part of the powder retaining cavity of the formed cartridge case. The inner polymeric skirt portion may comprise a further retaining portion, which engages with the flash hole aperture as formed internally within the MMC end cap.

The polymeric case may be formed from any polymer, such as for example, thermoset, thermoplastics, such polymers may be block polymers, co-polymers, elastomers, fluoroelastomers and combinations thereof. The polymers used in polymer cartridge cases are known in the art.

The polymeric case may be a fibre reinforced polymer composite case. The fibres may be fibre ply, fibres, chopped fibre, fibre threaded windings. The fibres may be any commonly used fibre such as, for example, glass, carbon, polymers, such as, for example polyaramid, metals.

The polymeric case may comprise particulate fillers, such as, for example, filaments, leaf or other particles.

The particulate fillers for the polymeric case may be any material, such as, for example metals, metalloids, ceramics, metal alloys thereof. The particulate fillers may be nano particulate, or multimodal loaded polymer composites. The nano particulate may be carbon, such as for example carbon nanotubes, graphene, graphitic fillers.

The fibres and/or particulate fillers for the polymer case may be present in the range of 5 to 80%, and the remainder the respective curable monomer to form the selected polymer case.

There may be some fibres affixed to the elongate protrusion prior to affixing or inert metal moulding the polymeric case, so as to provide a composite-metal bond.

The combination of a lightweight MMC end cap and a lightweight case, whether stainless steel, titanium or a polymer provides a leap forward.

The calibre may be selected from any calibre round.

According to a further aspect of the invention there is provided a composite end cap, suitable for forming a cartridge case, said end cap comprising an admixture of a reinforcement filler, a binder matrix material, wherein said admixture has been caused to solidify in the shape of said end cap.

Exemplary embodiments of the device in accordance with the invention will now be described with reference to the accompanying drawings in which:

FIG. 1 prior art brass cartridge case.

Figure 4A:
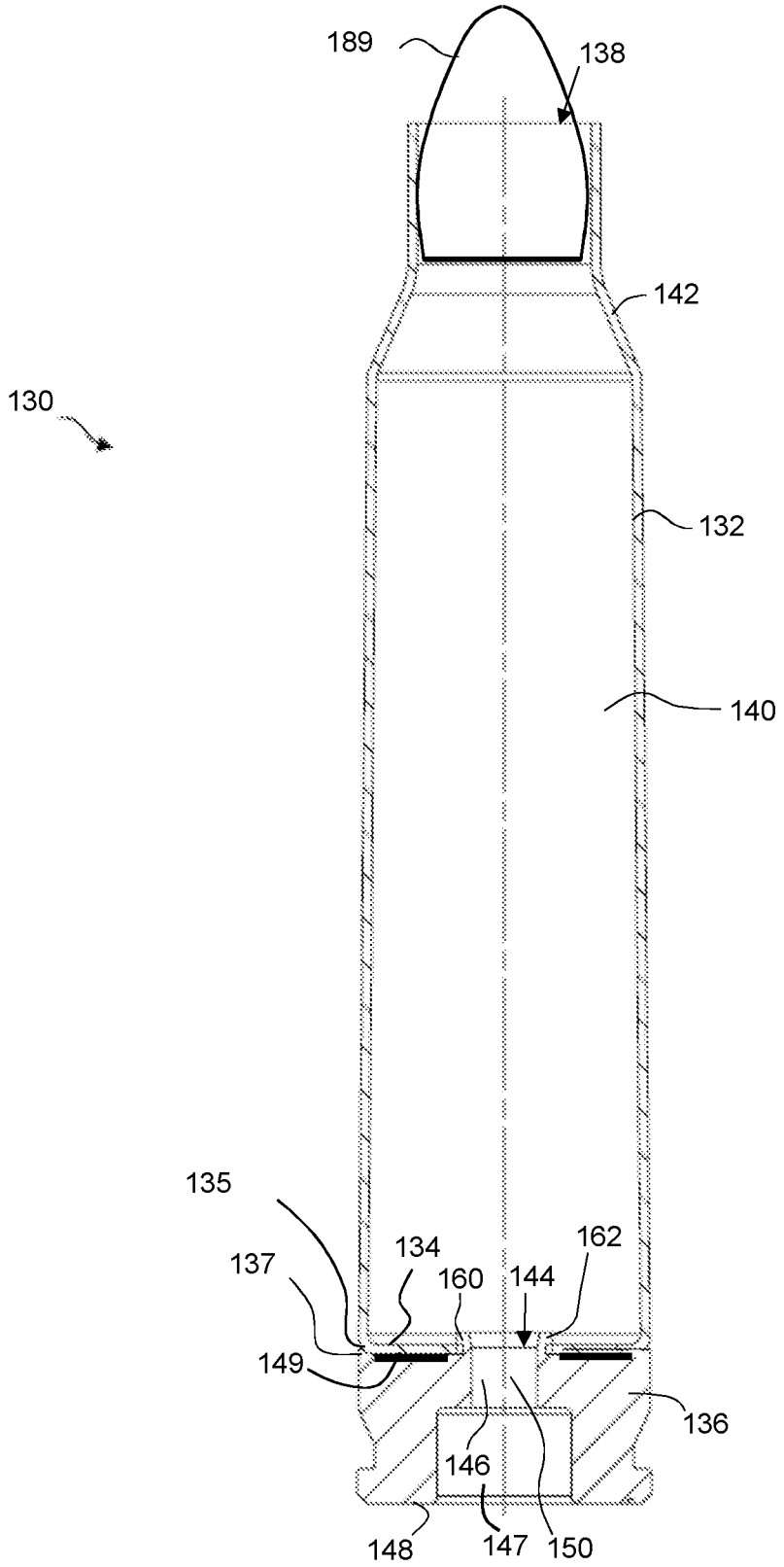
Figure 4B:
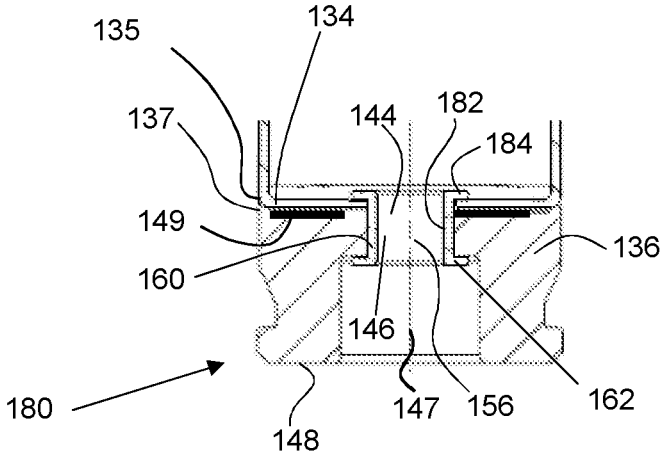
Figure 5:
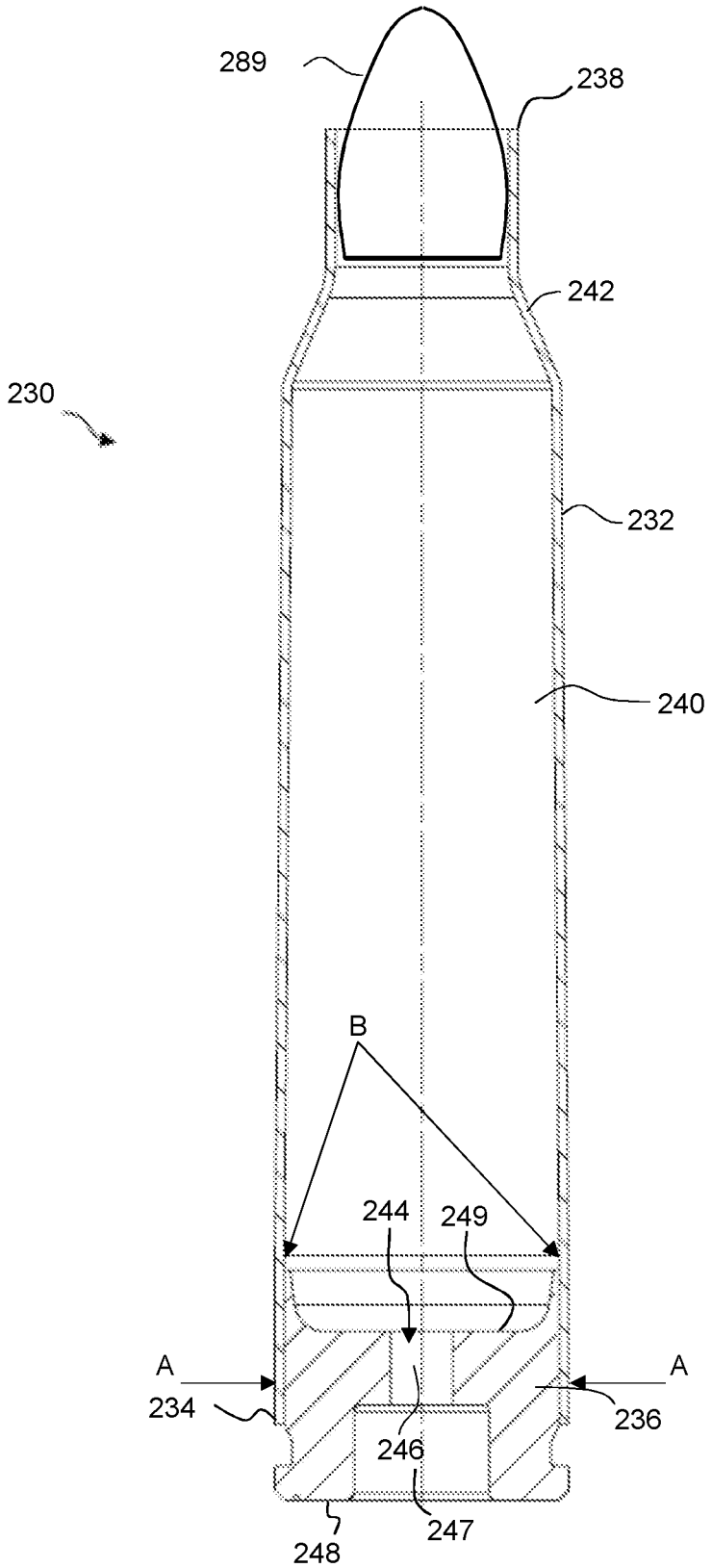

FIGS. 4*a* and 4*b* show mechanical fastening of a metal case and MMC end cap unit FIG. 5 shows a laser weld fastening of a metal case and MMC end cap unit.

Figure 6:
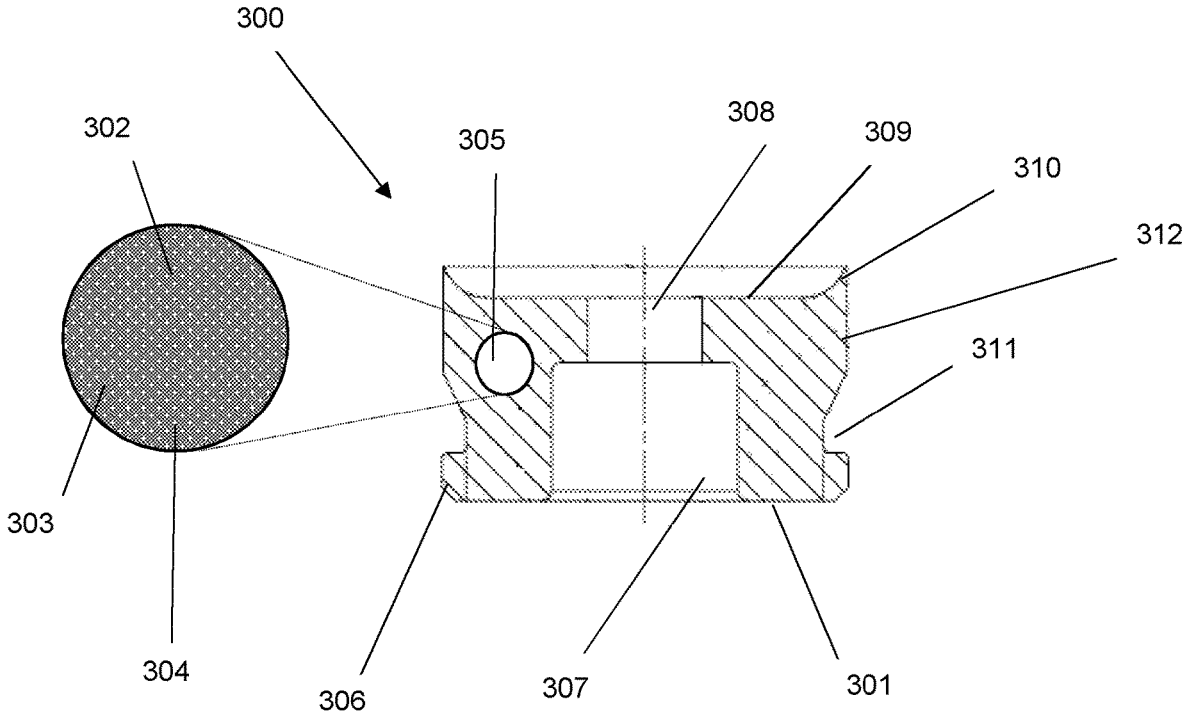

FIG. 6 shows a metal matrix composite MMC end cap

Figure 1:
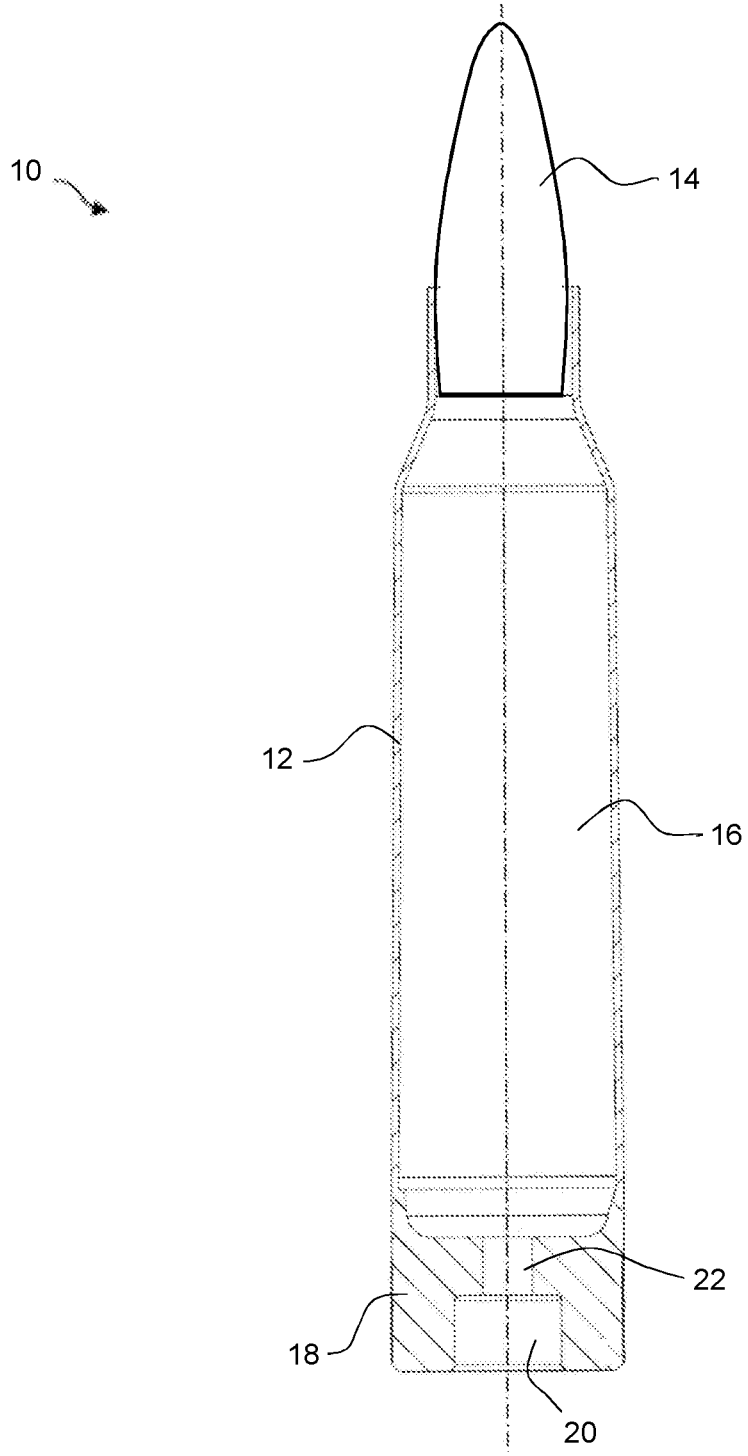
Fig 1 (prior art)
Figure 2:
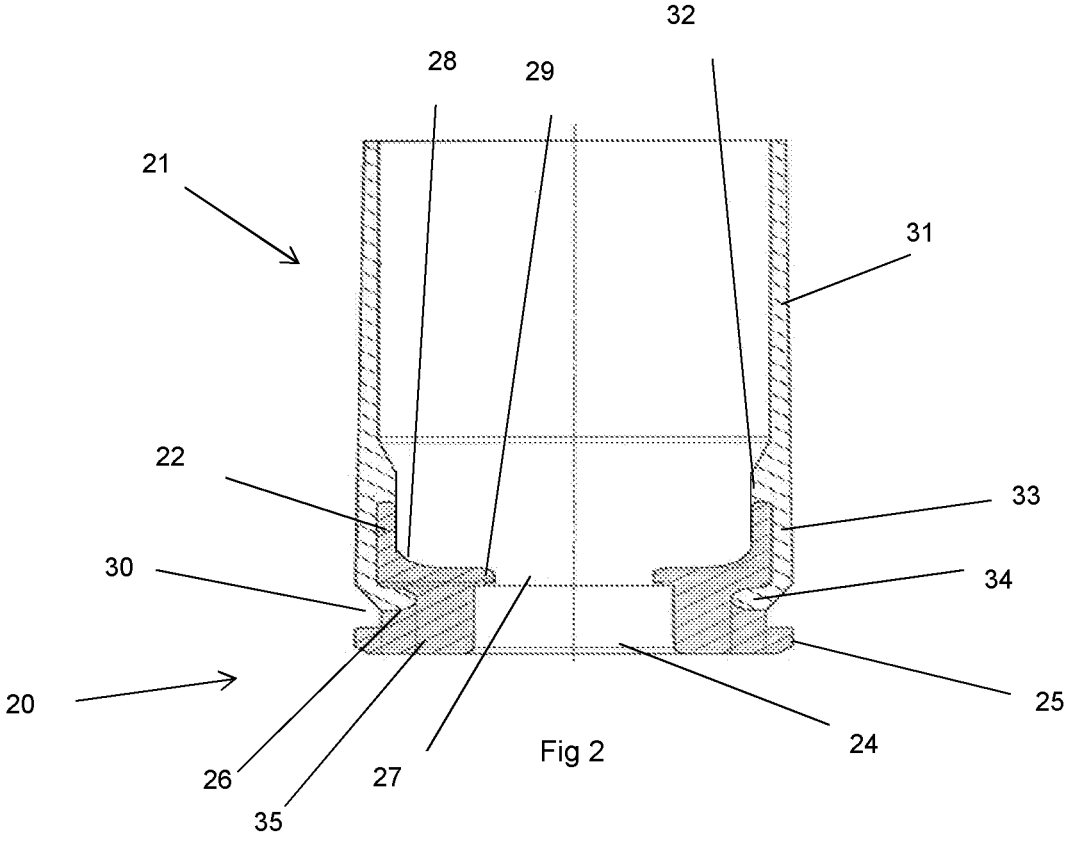
FIG. 2 shows a bonded arrangement of a polymer case and MMC MMC end cap

Turning to FIG. 1 there is a prior art, conventional cartridge casing 10. The cartridge assembly 10 comprises a casing 12 and a projectile 14. The casing 12 has a hollow section 16, which will contain propellant for displacement of the projectile 14. The casing 12 further comprises a head 18 at the end opposite to the projectile 14 which comprises a chamber 20 for a percussion cap, and a flash tube 22 for communication of an ignition charge from the percussion cap to the inside of the casing 12 and thus the propellant. The walls of the chamber 16 are formed integrally with the head 18. Such a cartridge casing may typically be formed of brass. This material choice has many advantages, for example, it is relatively easy to form into the desired shape. However, brass has demerit in that it is also relatively dense, and hence the casing 12 forms a relatively large percentage of the mass of the whole cartridge Referring to FIG. 2, there is provided a head unit 20, which comprises an enlarged head rim 25, on a MMC head unit 35. The MMC head unit 35, comprises an at least one further circumferential groove 26, which accommodates a retaining portion of the polymer case 34. The ejector groove 30 is in part formed by the enlarged head rim 25, and the retaining portion of the polymer case 34. The MMC metal coupling protrusion 22 engages with the polymer case 31, at the polymeric coupling end 33, and the forms an abutting engagement 32.

The MMC head unit 35, comprises a primer cavity 24, and a flash hole 27, to allow the output from the primer (removed for clarity) to transfer through to propellant in the final cartridge. The internal features such as the internal shoulder 28 and flash hole aperture 29, are produced during the MMC forming process.

Figure 3:
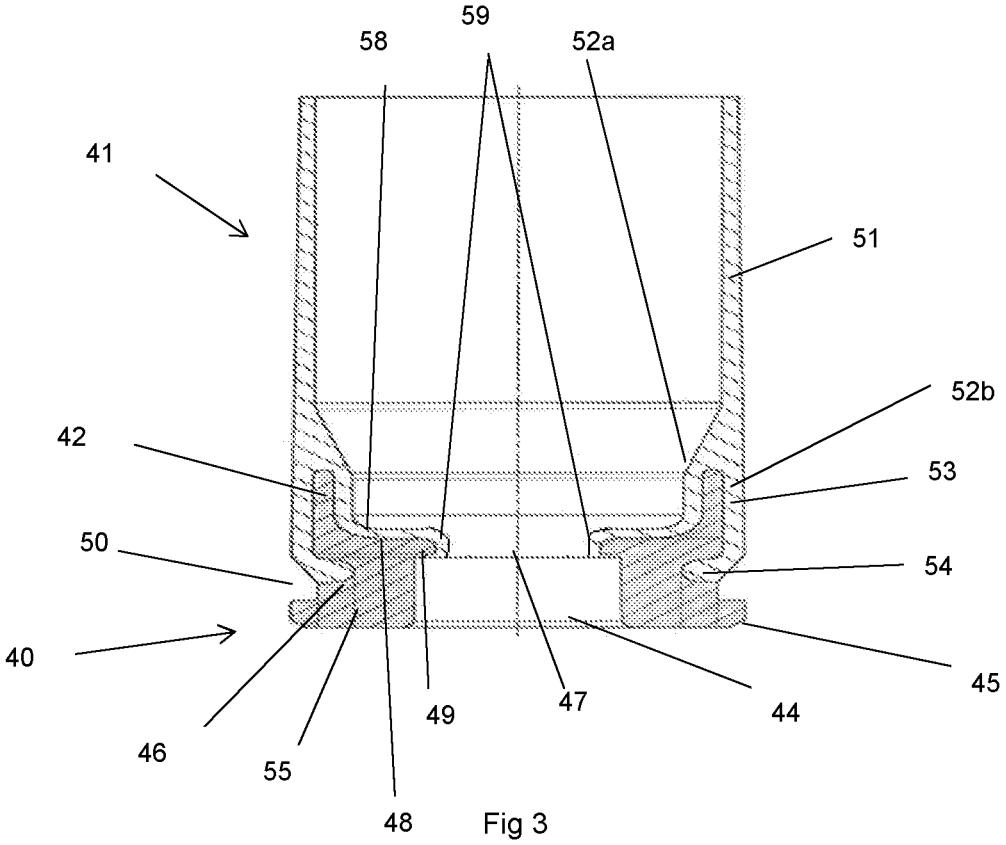
FIG. 3 shows an alternative bonded arrangement of a polymer case and MMC end cap unit.

Referring to FIG. 3, there is provided a head unit 40, which comprises an enlarged head rim 45, on a MMC head unit 55. The MMC head unit 55, comprises an at least one further circumferential groove 46, which accommodates a retaining portion of the polymer case 54. The ejector groove 50 is in part formed by the enlarged head rim 45, and the retaining portion of the polymer case 54. The MMC coupling protrusion 42 engages with the polymer case 51. The female polymeric coupling end 53, comprising the two skirt portions 52*a* and 52*b* envelope the MMC coupling protrusion 42.

The head unit 55, comprises a primer cavity 44, and a flash hole 47. In this arrangement the flash hole 47 is formed by the inner polymeric skirt portion 52*a*, which comprises a further retaining portion 59, which engages with the flash hole aperture 49. The further retaining portion 59 forms a narrower flash hole aperture 47. The flash hole 47 allows the output from the primer (removed for clarity) to transfer through to propellant in the final cartridge. The inner skirt portion 52*a* extends 58 and attaches to the internal shoulder 48 along its length.

The outer polymeric skirt portion 52*b* extends down the outside the metal coupling protrusion 42. The outer polymeric skirt 52*b* and enlarged head rim 45 have substantially the same diameter.

Turning to FIG. 4*a* shows a light weight metal cartridge casing 130. The cartridge casing 30 is configured for use in a rifled barrel of a gun, firearm or other such weapon.

The cartridge casing 130 comprises a casing tube 132 having a first end 134 which forms a base of the casing tube 132. The walls of the casing tube 132 turn at a corner edge 135 to define the first end 134. The corner edge 135 may have a radiused, or arcuate, cross-section.

The casing tube 132 abuts at least part of a MMC head cap 136 provided adjacent the first end 134. The MMC head cap 136 is configured to support and reinforce the base of the casing tube 132 to prevent it from swelling and rupturing during operation. In part it achieves this by providing reinforcement to the end wall of the casing tube 132 which abuts the head cap 136.

Additionally, the MMC head cap 136 is provided with a shoulder edge 137. The shoulder edge 137 may be formed integrally with the MMC head cap 136. The shoulder edge 137 is provided towards the outer edge of MMC head cap 136, and extends in a longitudinal direction away from the head cap 136. The shoulder edge 137 may have a radiused, or arcuate, cross-section. The corner edge 135 and shoulder edge 137 may be complementary in shape.

The corner edge 135 and shoulder edge 137 are sized and configured such that when the first end 134 of the casing tube 132 is seated on the MMC head cap 136, the corner edge 135 of the casing tube 132 sits within the space, or region, defined by the shoulder edge 137 of the MMC head cap 136. That is to say, the corner edge 135 and shoulder edge 137 are sized and configured such that when the first end 134 of the casing tube 132 is seated on the MMC head cap 136, the shoulder edge 137 of the MMC head cap 136 surrounds, encircles and/or bounds the corner edge 135 of the casing tube 132. Put another way, when the first end 134 of the casing tube 132 is fitted and located on the MMC head cap 136, the shoulder edge 137 of the MMC head cap 136 is substantially in contact with the whole of the circumference of corner edge 135 of the casing tube 132, and the shoulder edge 137 is configured to support loads induced in it by expansion of the casing. Thus, in operation, the shoulder edge 137 of the MMC head cap 136 prevents the corner edge 135 of the casing tube 132 from moving radially outwards, for example beyond its original circumference or the circumference of the MMC head cap 136.

The casing tube 132 further comprises a second end 138, which is open and configured to receive a projectile 189 opposite to the first end 134. The second end 138 has a diameter which may be substantially the same as, or less than, the diameter of the first end 134. In the example shown the diameter of the second end 138 is substantially less than the diameter of the first end 134.

The walls of the casing 132 define a substantially cylindrical thin walled chamber 140. The walls of the casing tube 132 are configured to contain a pressure in the chamber of up to about 500 MPa.

The MMC head cap 136 defines a passage 146 which extends all of the way through the MMC head cap 136 which in use will be a flash tube. The flash tube extends into a chamber 147 which, in use, will house a percussion cap (sometimes referred to as a "primer"). Thus the MMC head cap 136 has a percussion side 148 which, in use, faces away from the casing tube 132. The orifice 144 in the first end 134 of the casing tube 132 and head cap passage 146, when assembled in alignment, define a flash passage 150 which extends between the head cap percussion side 148 and the inside of the casing tube 132.

The MMC head cap 136 and casing tube 132 are held together by a deformable member 160. The deformable member 160 extends from the passage 146 of the MMC head cap 136 through the orifice 144 in the first end 134 of the casing tube 132 and aligns the passage 146 with the orifice 144.

In the example of FIG. 4*a* the deformable member 160 is provided as at least one deformable end, lip or region 162, which is deformable between a first shape (for example an undeformed configuration or state) in which the deformable member 160 may extend from the MMC head cap 136 through the casing tube 132 during assembly, and a second shape (for example a deformed configuration or state) which fixes the casing tube 132 and the MMC head cap 136 together. The deformable member 160 thus provides a mechanical joint between the MMC head cap 136 and casing tube 132.

In the example of FIG. 4*a* the deformable member 160 is integrally formed with the MMC head cap 136. The deformable member 160 is deformable by swaging the region of the lip 162 which extends beyond the wall which defines the orifice 144 of the casing tube 132 such that the lip 162 becomes pressed against the wall of the casing tube 132 and draws the MMC head cap 136 toward the base of the casing tube 132 to thereby clamp the casing tube 132 and MMC head cap 136 together.

An alternative example of a cartridge casing 180 according to the present disclosure is shown in FIG. 4*b*. The example of FIG. 4*b* is similar in many ways to the cartridge case shown in, and as described with reference to, FIG. 4*a*. Features common to the examples of FIG. 4*a* and FIG. 4*b* are referred to using the same reference numerals.

In the FIG. 4*b* example the deformable member 160 is provided as a rivet like element 182 which is provided separately to the MMC head cap 136 and casing tube 132. The deformable member 182 is cylindrical, hollow and thin walled. The deformable member 182 (rivet) extends along the passage 146 in the MMC head cap 136 and through the orifice 144 in the first end of the casing tube 132. The deformable member 182 is provided with at least one deformable end, or lip, 162 which is deformable between a first shape (for example an undeformed configuration or state) in which the deformable member 182 may extend between the casing tube 132 and the MMC head cap 136 during assembly, and a second shape (for example a deformed configuration or state) which fixes the casing tube 132 and MMC head cap 136 together. For example, the deformable end 162 of the deformable member 182 may be swaged to bring the MMC head cap 136 and casing tube 132 into a fixed relationship relative to one another.

The deformable end 162 of the deformable member 182 may take the form of a region of material which is configured to extend beyond the orifice 144 and passage 146 into the percussion cap chamber 147, which may then be swaged to form a clamping flange. Alternatively the deformable end 162 may be configured to extend into the casing tube 132. In such examples the deformable member 182 may be provided with a shoulder 184 of greater diameter than the orifice 144 and passage 146, on the opposite end of the deformable member 182 to the deformable region 162, such that the deformable member 182 is trapped against one side of the orifice 144 and passage 146.

Alternatively, a deformable end 162 may be provided at both ends of the deformable member 182 such that both end regions of the deformable member 182, that is to say the region which extends into the percussion cap chamber 147 and the region the extends into the casing tube 132, may be deformed to clamp against the MMC head cap 136 and the casing tube 132 respectively.

Put another way, the deformable member 182 is deformable by swaging either the region of a lip 162 which extends beyond the wall which defines the orifice 144 of the casing tube 132 and/or by swaging the region of a lip 162 which extends beyond the flash tube 144 into the percussion cap chamber 147. Swaging causes the lip 162 to become pressed against the wall of the casing tube 132 and/or MMC head cap 136 to thereby draw the MMC head cap 136 toward the base of the casing tube 132 to thereby clamp the casing tube 32 and MMC head cap 136 together.

The casing tube 132 may be formed from a metal, metallic material or metal alloy comprising, for example, aluminium or a titanium. In one example the casing tube 32 may comprise ferritic alloys, for example stainless steel. The casing tube 32 may alternatively be formed from non metallic material and/or metal-plastic composite material. The deformable member 160, i.e. the rivet 160, may be made of the same or a different material to the tube casing, for example stainless steel, titanium, brass or coated mild steel. Turning to FIG. 5, shows an example cartridge casing 230 according to the present disclosure. The cartridge casing 230 comprises a casing tube 232 having a first end 234 which is closed by a MMC head cap 236. The casing tube 232 is substantially cylindrical and has an internal diameter at the first end 234 which receives the MMC head cap 236. The casing tube 232 bounds at least part of the MMC head cap 236 entered into its first end 234. The MMC head cap 236 is configured to support and reinforce the base of the casing tube 232 to prevent it from swelling and rupturing during operation. As will be described in more detail later, the MMC head cap 236 is welded to the casing tube 232, thereby fixing the MMC head cap 236 and casing tube 232 relative to one another.

In the context of the present disclosure, "welding" is intended to cover joining processes that produce bonding of materials by heating, which may be done with or without pressure or filler material. For example, the term is intended to encompass brazing and soldering. It may also be taken to encompass a process in which the material of one or more articles being joined are brought into a molten state to facilitate bonding. It may include a process in which the base materials melt along with a filler material.

The casing tube 232 further comprises a second end 238, which is open and configured to receive a projectile 289 opposite to the first end 234. The second end 238 has a diameter which may be substantially the same as, or less than, the diameter of the first end 234. In the example shown the diameter of the second end 238 is substantially less than the diameter of the first end 234.

The walls of the casing 232 define a substantially cylindrical thin walled chamber 240. The tube casing 232 has a substantially constant diameter along a first region of its length between the first end 234 and the second end 238. However, the cylindrical thin walled chamber 240 may have a taper (for example <1°) along at least part or all of its length.

The MMC head cap 236 defines a passage 246 which extends all of the way through the MMC head cap 236 which in use will be a flash tube (or "flash passage"). The flash tube/passage 246 extends into a chamber 247 which, in use, will house a percussion cap (sometimes referred to as a "primer"). Thus the MMC head cap 236 has a percussion side 248 which, in use, faces away from the casing tube 232. The MMC head cap 236 further comprises a charge side 249 which, in use, defines part of the internal surface of the cartridge casing 230. Thus the flash passage 246 extends between the percussion side 248 and the charge side 249.

The MMC head cap 236 has an external diameter at least part way along its outer periphery sized such that it fits within the first end 234 of the casing tube 232. The relative dimensions of the internal diameter at the first end 2234 of the casing tube 232 and the external diameter of corresponding region of the MMC head cap 236 may be such when the MMC head cap 236 is located in the casing tube 232 they form an interference fit with one another.

The casing tube 232 and MMC head cap 236 may comprise a welded join which bonds them together in a region where they form an interference fit with one another. For example, the join may be provided around the circumference of the casing tube 232 and MMC head cap 236 in a region where they interface with one another. Such a region is indicated with arrows "A". The join may be a through weld or stake weld.

Alternatively the casing tube 132 and MMC head cap 236 may comprise a join which bonds them together in the interior of the casing tube 232, for example in a region around a circumferential edge of an interface between the casing tube 232 and the MMC head cap 236. Such a region is indicated with arrows "B".

The weld may achieved by laser welding. Alternative weld joins may be provided which brought only material of the casing tube 232 into a molten state, or brought material of both the casing tube 232 and MMC head cap 236 into a molten state. The weld join may have been provided by any one of the welding processes as hereinbefore defined.

FIG. 6 provides a MMC end cap 300, comprises a rim 306, an ejector groove 311, formed as a recess in the side wall 312 and rim 306, for locating with an ejection mechanism (not shown) in a rapid fire gun. There end cap comprises a first cavity the cap chamber 307 for receiving a primer cap (not shown), and a second cavity—a fire hole 308, which is through-hole through which the primer cap's energetic output travels to initiate the gun propellant located in the adjoining cartridge case. The rear face 101 typically comprises the manufactures makers mark, for identification purposes. The end cap is formed from an MMC 305, which comprises a metal 302, binder 303 and optionally reinforcement particles 304.

The MMC end cap 300 may be secured to the case (not shown), via an abutment to the upper surface 309. The abutment may be reinforced by mechanical, chemical or physical fastenings. The protrusion 310, may be a shoulder for engagement with a metal case, or the protrusion 310 may be caused to elongated to provide a greater surface area for use with a polymer case.

The invention claimed is:

1. An ammunition round, comprising:

a metal matrix composite (MMC) end cap, said end cap comprising an admixture including a metal powder and a binder matrix material, wherein said admixture has been caused to solidify in the shape of said end cap;

a case formed from stainless steel material, said case and end cap forming a cartridge case;

primer;

propellant; and a projectile located in said cartridge case arranged to form said ammunition round;

wherein said case is mechanically joined to the end cap by a deformable member.

2. The ammunition round of claim 1, wherein the metal powder is selected from aluminium composites, magnesium composites or copper composites.

3. The ammunition round according to claim 1, wherein the binder matrix material is selected from a further metal powder, polymers, ceramics.

4. The ammunition round according to claim 3, wherein the further metal powder has a lower density than the metal powder.

5. The ammunition round according to claim 1, wherein the admixture further comprises reinforcement particulates in the range of greater than 10%.

6. The ammunition round according to claim 5, wherein the reinforcement particulates are selected from $ZrO_2$, TiC, TiN, AlN, graphite, clay, SiC, $Al_2O_3$, and $B_4C$.

7. The ammunition round according to claim 1, wherein the admixture is consolidated, cured, or sintered by hot isostatic pressing.

8. The ammunition round of claim 1, wherein said deformable member is integrally formed with the end cap.

9. The ammunition round according to claim 1, wherein a weather seal is located between the end cap and the case.

10. The ammunition round according to claim 1, wherein a sealant is located between the end cap and the case.

11. The ammunition round according to claim 1, wherein said deformable member is a rivet.

12. An ammunition round, comprising:

a metal matrix composite (MMC) end cap comprising an admixture including a metal powder and a binder matrix material, said admixture being solidified in the shape of said end cap; and a case formed from stainless steel material, the case and end cap forming a cartridge case;

wherein the case is mechanically joined to the end cap by a deformable member.

13. The ammunition round according to claim 12, further comprising:

a primer cap; and a projectile located in said cartridge case.

14. The ammunition round according to claim 12, wherein the deformable member is integrally formed with the end cap; and/or wherein the deformable member has a deformable end in its deformed state thereby fixing the case and the end cap together.

15. The ammunition round according to claim 12, wherein the admixture further comprises reinforcement particulates in the range of greater than 10%.

16. An ammunition round, comprising:

a metal matrix composite (MMC) end cap comprising an admixture including a metal powder, a binder matrix material, and reinforcement particulates, said admixture being solidified in the shape of said end cap;

a case formed from stainless steel material, the case and end cap forming a cartridge case;

a primer cap; and a projectile located in said cartridge case;

wherein the case is mechanically joined to the end cap by a clamping flange.

17. The ammunition round according to claim 16, wherein the clamping flange is part of a deformable member that extends along a passage in the end cap and through an orifice of the case, the clamping flange fixing the case and end cap together.

18. The ammunition round according to claim 16, wherein the clamping flange is part of an element, and the element either:

is integral with the end cap and extends from the end cap through an orifice of the case, the clamping flange fixing the case and end cap together; or is separate from both the end cap and the case, the clamping flange being one of a first clamping flange and a second clamping flange, the element extending along a passage in the end cap and through an orifice of the case, the first and second clamping flanges fixing the case and end cap together.

19. The ammunition round according to claim 16, wherein the case is mechanically joined to the end cap by a mechanical rivet join that includes the clamping flange, the ammunition round including a sealant between the end cap and the case.

20. The ammunition round according to claim 12, wherein the deformable member is a rivet.

* * * * *